United States Patent [19]

Anderson

[11] 4,041,656

[45] Aug. 16, 1977

[54] DEVICE FOR PREVENTING ICE FORMATION ON A ROOF

[76] Inventor: Ralph Anderson, 665 Kallstrom Road, Cloquet, Minn. 55720

[21] Appl. No.: 697,223

[22] Filed: June 17, 1976

[51] Int. Cl.[2] ..... E04D 13/00

[52] U.S. Cl. ..... 52/16; 52/12; 137/67

[58] Field of Search ..... 52/16, 11, 12, 13, 15, 52/24, 25, 26; 61/12, 14, 15; 137/67

[56] References Cited

U.S. PATENT DOCUMENTS

| | | | |
|---|---|---|---|
| 115,340 | 5/1871 | Miller | 52/16 |
| 133,247 | 11/1872 | Park | 52/16 |
| 1,085,474 | 1/1914 | Peterson | 52/15 |
| 2,887,073 | 5/1959 | Thompson | 52/16 |
| 3,060,952 | 10/1962 | Bystrom | 52/16 |
| 3,077,055 | 2/1963 | Tripp, Jr. | 52/12 |
| 3,133,377 | 5/1964 | Jackson | 52/15 |
| 3,805,460 | 4/1974 | Middleby | 52/16 |
| 3,889,474 | 6/1975 | Frangmeger | 52/16 |

FOREIGN PATENT DOCUMENTS

| | | | |
|---|---|---|---|
| 2,035,296 | 1/1972 | Germany | 52/16 |
| 6,716,785 | 6/1969 | Netherlands | 52/12 |

*Primary Examiner*—Price C. Faw, Jr.
*Assistant Examiner*—Robert C. Farber
*Attorney, Agent, or Firm*—Wicks & Nemer

[57] ABSTRACT

A device for draining melted snow from a roof including an adjustable collector tube having means for securing it to a roof at the lower edge of the roof together with a screen unit mounted within the collector tube and spaced from a wall of the tube and means for maintaining a melting agent on the screen whereby ice built up to the screen is melted by the melting agent thereby causing the same to run out of the collector tube.

9 Claims, 10 Drawing Figures

FIG. 6
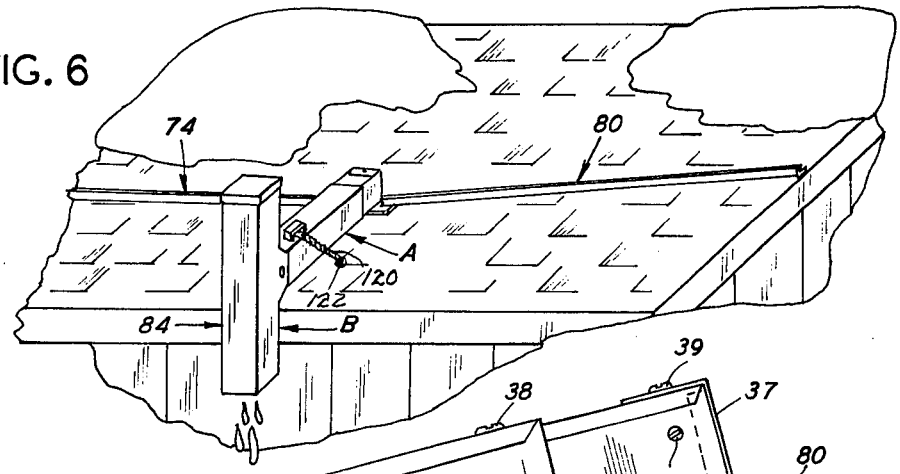
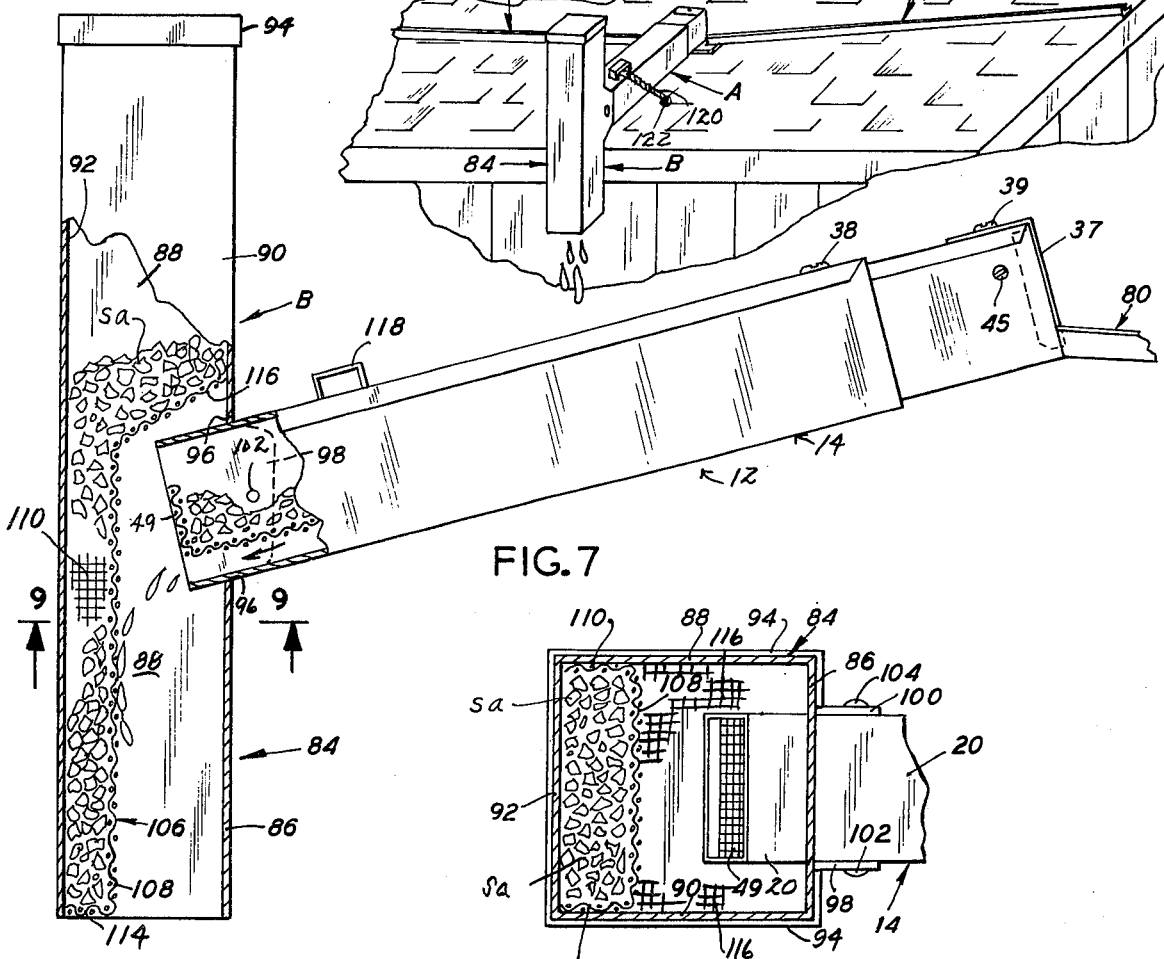
FIG. 7
FIG. 9
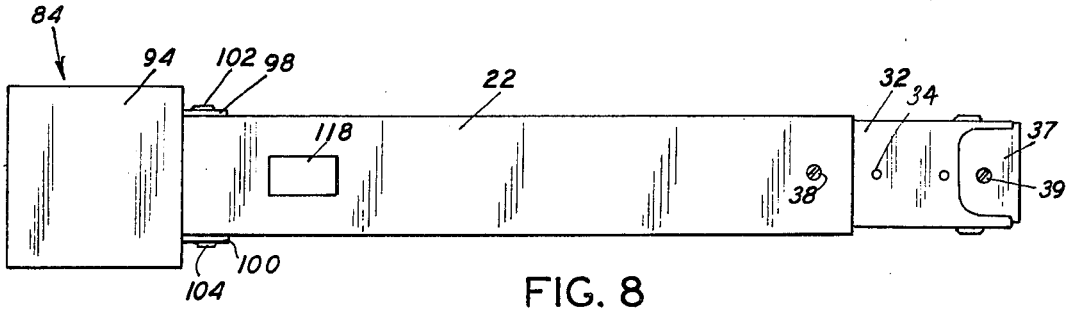
FIG. 8

DEVICE FOR PREVENTING ICE FORMATION ON A ROOF

SUMMARY

The invention herein disclosed relates to an improvement in a device for draining melted snow from a roof thereby preventing the progressive buildup of ice, which through repeated melting and freezing may cause water to seep under the roofing and into a building structure where it can cause extensive damage.

It is the object of the invention to provide a tubular collector member which is positioned on a roof at the lower edge thereof together with small gutter members attached to the roof for collecting and directing melted snow in the form of water to the device. The collector member is provided with a screen which supports a supply of salt or other melting agent at a point above the bottom of the tubular member. When water passing under the salt builds up an ice formation and it approaches the salt on the screen the salt causes the ice to melt and open passage ways therein through which water drains from the device and away from the building structure. The device is positioned on a roof at a point where ice buildup has been occurring and where leakage through the roof is likely.

In the drawings forming part of this application:

Figure 1:
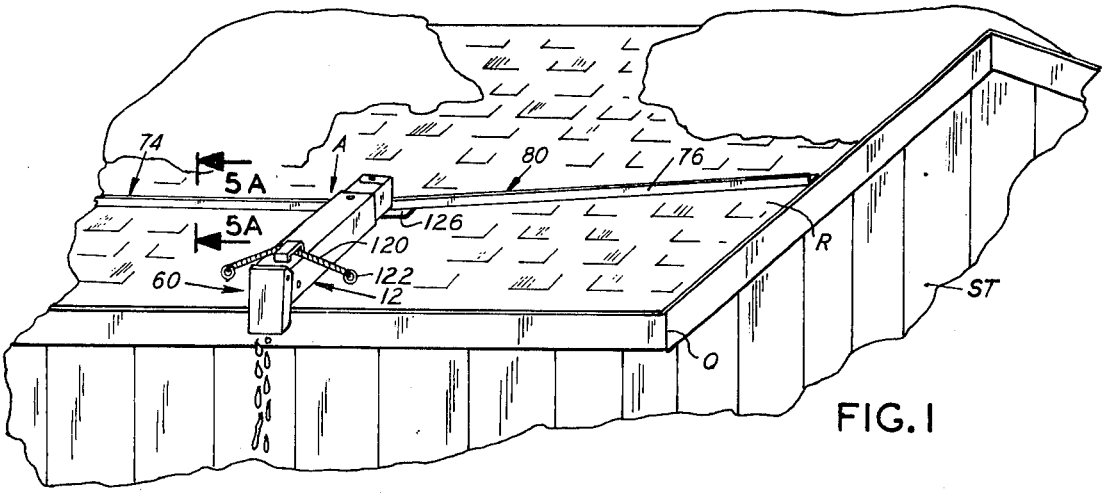
FIG. 1 is a perspective view of a device for draining melted snow from a roof shown on a roof and embodying the invention.
Figure 2:
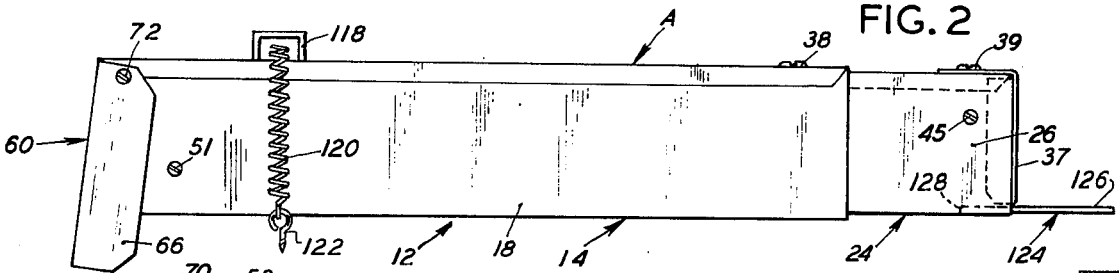
FIG. 2 is a longitudinal side view of the device.
Figure 3:
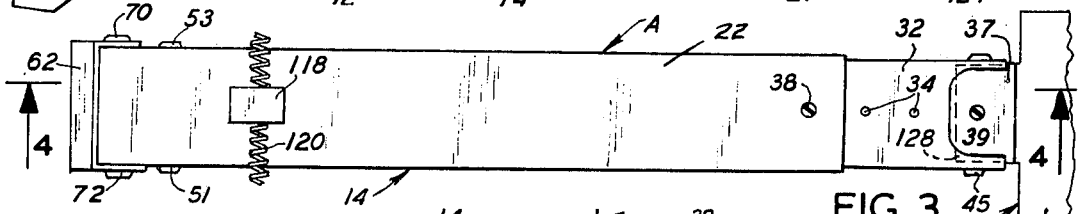
FIG. 3 is a top plan view thereof.
Figure 4:
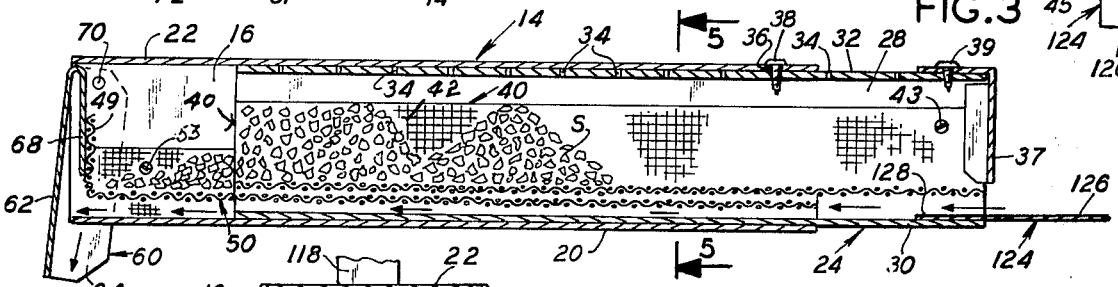
FIG. 4 is a sectional view on the line 4—4 of FIG. 3.
Figure 5:
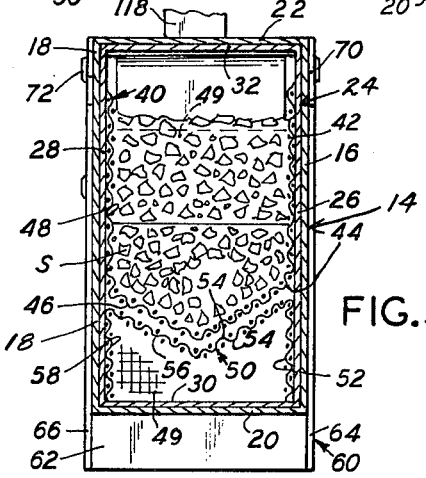
FIG. 5 is a sectional view on the line 5—5 of FIG. 4.
Figure 5A:
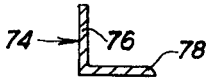

FIG. 5*a* is a sectional view on the line 5*a*—5*a* of FIG. 1.

FIG. 6 is a perspective view of a further embodiment of the invention shown on a roof.

FIG. 7 is a side elevational view of the device portions of which are broken away.

FIG. 8 is a top plan view of the device of FIGS. 6 and 7.

FIG. 9 is a sectional view on the line 9—9 of FIG. 7.

Referring to the drawings in detail, the device A includes the collector tube 12 which includes the outer tubular portion 14 open at each end and including the sidewalls 16 and 18, the bottom wall 20 and the top wall 22.

Further provided is the inner tubular portion 24 of the collector tube 12 open at each end and including the sidewalls 26 and 28, the bottom wall 30 and the top wall 32. As will be noted the tube portions 14 and 24 are rectangular in cross-section and the member 24 is of a size that it slideably fits into the portion 14. The top of portion 32 is formed with a series of holes 34 and the top 32 of portion 24 formed with a hole 36 through which is mounted the metal screw 38 which is screwed into engagement with any of the holes 34 to thereby provide an adjustable length collector tube 12.

The inner end of the portion 24 is formed with the filler end cap 37 removably secured to the end by means of the metal screw 39. The cover allows filling of the tubular member 12 and it prohibits snow from blowing into the open end of tubular member 12. The numberal 40 designates a first screen which includes the sidewall 42 which terminates at its lower edge in the obliquely extending half portion 44 which in turn terminates in the oblique portion 46 which in turn terminates in the sidewall 48 parallely disposed to the wall 42. The half bottom portions 44 and 46 form a V-shaped screen bottom. The screen 40 is secured within the member 24 by means of the metal screws 43 and 45 secured to the walls 16 and 26.

The numeral 50 designates a second screen which includes the sidewall 52 terminating at its upper edge in the inwardly and obliquely depending half top wall portion 54 which terminates in the oblique and upwardly extending wall 56. The screen portion 56 terminates in the sidewall 58 parallely opposed to the sidewall 52. The lower edges of the sidewalls 52 and 58 rest on the bottom wall 30 of the tubular portion 24 thereby supporting the screen therein. The sidewalls 52 and 58 are of a transverse dimension whereby the top portions 54 and 56 support the walls 44 and 46 of top screen 48. The screen 40 can thus be adjustably moved by means of the member 24 relative to screen 50. The screen 50 also includes the end portion 49 which maintains salt within the screen 50 and at the outer end and it is secured to the wall 28 of the member 24 by means of the metal screws 51 and 53.

Further provided is the deflector member 60 including the plate portion 62 from which the side flanges 64 and 66 extend. Depending from the upper edge of the plate portion 62 is lip 68. The deflector member 60 is secured to the end of the tubular portion 14 by means of the metal screws 70 and 72.

The numeral 74 designates a first gutter member which is a length of angle iron formed with right angle sidewalls 76 and 78. A second gutter member 80 is also provided which is identical to gutter member 74.

In use of the device A, rock salt S or other melting agent is placed within the screen 40 and screen 50 and the member 24 adjustably positioned relative to the member 14 depending upon the distance from the edge of the roof overhang O to a point on the roof in line with the wall of the building structure ST. The upper end of the device A is substantially at a point in line with the upper end of the wall. The gutter members 74 and 80 are secured to the roof R with the inner ends at the upper end of the device A and slanted so as to direct water to the upper open end of the device. Water passes into and through the device beneath the screens and it remains fluid due to low volume converted to high water volume. The water runs outwardly from the lower end of the device. The deflector 60 acts as a wind shield to prevent wind from blowing into the outer end of the device which tends to form ice.

When the high volume water flow reduces to low volume at the end of the day, the water freezes to ice up to the screen. As a result the salt melts the ice. The next day when melting again occurs the water runs over the ice formed in the tube and contacts the salt thereby melting the ice. With the screens formed as a V at the bottom there is a limited volume of salt at the initial point of contact of the water with the salt thereby using less salt.

FIGS. 6–8 illustrate a further embodiment of the invention wherein is found the construction of the device illustrated as A but without the deflector 60. Further provided is the vertical downspout member B which is used in conjunction with the above referred to device A particularly for use with roofs on commercial buildings where relatively large icicles form. The member B includes the tubular formation 84 which includes the rear wall 86, the sidewalls 88 and 90 and the front wall 92. The tubular member 84 is open at the bottom and closed off at the top with the removable filler cap 94.

The rear wall 86 of the member 84 is formed with the opening 96, through which extends the outer end of the member 14. The member 14 is secured to the tubular formation 84 by means of the spaced ears 98 and 100 formed on sides of the opening 96 and secured to the sidewalls of the member 14 by means of the metal screws 102 and 104.

Positioned within the tubular member 84 is the screen 106 which includes the main flat portion 108 which terminatesat each edge in the sidewalls 110 and 112 the lower ends of which terminate in the bottom end portion 114. The upper end of the main flat screen portion 108 terminates in the upper end portion 116 the end of which abuts the wall 86. With the screen 106 in place it forms a pocket for rock salt Sa spaced from the wall 86 and the end of the member 14. As water issues from the end of the member 14 it falls downwardly into tube 84 and outwardly therefrom.

When there is a high volume of water downwardly through tube 84 and some freezing, then the water contacts the screen and salt Sa whereby the effect of the salts melts the ice formed and forms a pathway thereon for the water to pass through the tube 84. The downspout B prevents wind from entering the member A which aids in preventing the formation of ice. The upper end portion of the member B acts as reservoir for salt Sa.

Secured to the top of the top wall 22 of the outer tubular portion 14 is the U-shaped strap 118 through which is extended the coil spring 120 secured at each end to the roof by means of a screw eye 122. Also provided is the flat plate 124 including the main portion 126 and the reduced portion 128. The plate 124 is placed on the roof at the upper open end of the collector tube portion 24 with the reduced portion 128 extended into the tube portion 24. The inner ends of the gutter members 74 and 80 are positioned upon the portion 126 of the plate 124 whereby water runs onto the plate from the gutter members and into the tubulr portion of the collector tube 12.

The embodiment of FIGS. 6–9 provides a no freeze downspout which provides dripless removal of water. Water runs into the downspout 84 between the wall 86 and the screen 106 until it freezes and it then runs into the salt Sa where the ice is thereby melted which allows further flow of water from the downspout. The device of FIGS. 6–9 can be installed on commercial and industrial buildings to prevent large icicles from forming. It has been found that one filling of salt will last an entire winter season due to the fact that the V-shaped screen presents a minimal of salt at the water beneath the same.

Having thus described the invention, what is claimed as new and desired to be secured by letters Patent is:

1. Device for draining melted snow from a roof comprising:

a. a collector tube having spaced sidewalls joined by a top and a bottom wall and open at both ends, b. an elongated screen member mounted in said tube and spaced from the bottom wall of said tube adapted to contain c. ice melting material thereon, and d. means extending substantially laterally from said tube for directing melted snow to one end of the tube for travel under said screen upon said bottom and out the other end of said tube.

2. The device of claim 1 in which said collector includes:

a. an outer tubular portion having b. an inner tubular portion slidably positioned within said outer tubular portion and c. means for adjustably securing said tubular portions in fixed relationship.

3. The device of claim 2 in which the screen in transverse section is V-shaped.

4. The device of claim 3 in which said collector tube has a deflector on one end thereof.

5. The device of claim 4 in which the collector tube carries means for securing the same to a roof.

6. The device of claim 1 in which said collector tube includes a. a downspout mounted on one end thereof, and b. screen means in said downspout for containing a melting agent therein.

7. The device of claim 1 in which the screen in transverse section is V-shaped.

8. The device of claim 1 in which said collector tube has a deflector on one end thereof.

9. The device of claim 4 in which the collector tube carries means for securing the same to a roof.

* * * * *